US008360431B2

(12) United States Patent
Pececnik et al.

(10) Patent No.: US 8,360,431 B2
(45) Date of Patent: Jan. 29, 2013

(54) SHUFFLING APPARATUS

(75) Inventors: Joze Pececnik, Kamnik (SI); Mirko Klanjscek, Ljubljana (SI); Ivo Zavbi, Kamnik (SI); Ales Zupancic, Kamnik (SI); Peter Kroselj, Kamnik (SI); Urban Bergant, Kamnik (SI)

(73) Assignee: Elektroncek D.D., Menges (SI)

( * ) Notice: Subject to any disclaimer, the term of this patent is extended or adjusted under 35 U.S.C. 154(b) by 1097 days.

(21) Appl. No.: 12/324,919

(22) Filed: Nov. 28, 2008

(65) Prior Publication Data

US 2009/0243213 A1 Oct. 1, 2009

(30) Foreign Application Priority Data

Nov. 29, 2007 (AU) ..... 2007906534

(51) Int. Cl.
*A63F 13/00* (2006.01)

(52) U.S. Cl. ..... 273/149 R; 273/149 P; 463/43; 463/47

(58) Field of Classification Search ..... 273/149 R, 273/149 P; 463/43, 47
See application file for complete search history.

(56) References Cited

U.S. PATENT DOCUMENTS

| | | | | |
|---|---|---|---|---|
| 4,232,861 | A | | 11/1980 | Maul |
| 4,513,969 | A | | 4/1985 | Samsel, Jr. |
| 4,586,712 | A | | 5/1986 | Lorber et al. |
| 5,000,453 | A | * | 3/1991 | Stevens et al. ..... 273/149 R |
| 5,067,713 | A | * | 11/1991 | Soules et al. ..... 273/149 P |
| 5,121,921 | A | | 6/1992 | Friedman et al. |
| 5,240,140 | A | | 8/1993 | Huen |
| 5,275,411 | A | | 1/1994 | Breeding |
| 5,695,189 | A | | 12/1997 | Breeding et al. |
| 6,250,632 | B1 | | 6/2001 | Albrecht |
| 2005/0062229 | A1 | | 3/2005 | Grauzer et al. |
| 2005/0206076 | A1 | | 9/2005 | Ohira |
| 2007/0194524 | A1 | | 8/2007 | Toyama et al. |

FOREIGN PATENT DOCUMENTS

| | | |
|---|---|---|
| JP | 58149783 | 9/1983 |
| JP | 2005052226 | 3/2005 |

OTHER PUBLICATIONS

International Search Report and Written Opinion for International Patent Application Serial No. PCT/AU2008/001767, mailed Feb. 4, 2009.

* cited by examiner

*Primary Examiner* — James S McClellan
(74) *Attorney, Agent, or Firm* — Mark A. Litman & Associates, P.A.

(57) ABSTRACT

A shuffling apparatus comprising: at least three card holders, each adapted to hold at least one deck of cards; a conveying mechanism adapted to convey cards between each card holder and at least two other card holders, the conveying mechanism controllable to select a destination card holder of the at least two card holders; and a controller arranged to control the conveying mechanism in a shuffling mode in which cards are sent between a source card holder and selected ones of the at least two destination card holders.

29 Claims, 12 Drawing Sheets

900

920

910

| | ♥ | ♠ | ♦ | ♣ |
|---|---|---|---|---|
| | Hearts | Spades | Diamonds | Clubs |
| Cards | H | S | D | C |
| A | 01 | 14 | 27 | 40 |
| 2 | 02 | 15 | 28 | 41 |
| 3 | 03 | 16 | 29 | 42 |
| 4 | 04 | 17 | 30 | 43 |
| 5 | 05 | 18 | 31 | 44 |
| 6 | 06 | 19 | 32 | 45 |
| 7 | 07 | 20 | 33 | 46 |
| 8 | 08 | 21 | 34 | 47 |
| 9 | 09 | 22 | 35 | 48 |
| 10 | 10 | 23 | 36 | 49 |
| J | 11 | 24 | 37 | 50 |
| Q | 12 | 25 | 38 | 51 |
| K | 13 | 26 | 39 | 52 |
| Joker | 53 | | | |

Figure 9

SHUFFLING APPARATUS

RELATED APPLICATION

This application claims priority to Australian Patent Application No. 2007906534, having a filing date of Nov. 29, 2007, which is incorporated by reference herein in its entirety.

FIELD

The present invention relates to a shuffling apparatus, a shuffling method, a shuffling controller, a shuffling dealing method, a feeding mechanism, a continuous loop shuffling apparatus, a dealing apparatus, a playing card, and a processing apparatus.

BACKGROUND

Automatic card shufflers have been employed in casinos and the like to shuffle one or more decks of cards for playing card games such as black jack, poker, and baccarat.

The advantage of employing a shuffling apparatus is that it is seen as reducing the prospects of tampering. Current card shuffling mechanisms have a number of disadvantages including that they still require a human dealer, the shuffling mechanism can jam, and the outcome of the shuffling may not be random.

Accordingly, there is a need for an alternative shuffling apparatus.

SUMMARY OF THE INVENTION

In a first aspect, the invention provides a shuffling apparatus comprising:

- at least three card holders, each adapted to hold at least one deck of cards;
- a conveying mechanism adapted to convey cards between each card holder and at least two other card holders, the conveying mechanism controllable to select a destination card holder of the at least two card holders; and
- a controller arranged to control the conveying mechanism in a shuffling mode in which cards are sent between a source card holder and selected ones of the at least two destination card holders.

In an embodiment, the conveying mechanism comprises at least one switching mechanism controllable by the controller to control the destination.

In an embodiment, the controller is arranged to control the conveying mechanism in a moving mode in which cards are sent between one source card holder and one destination card holder.

In an embodiment, the at least three card holders comprise at least four card holders comprising two pairs of card holders, and wherein the controller is arranged to conduct at least one shuffling round during which one pair of card holders are source card holders and the other pair of card holders are destination card holders, the controller controlling the conveying mechanism to distribute cards from a first of the pair of source card holder between the pair of destination card holders and subsequently distribute cards from a second of the pair of source card holders between the pair of destination card holders.

In an embodiment, subsequent to distribution of the cards to the destination card holders, the roles are reversed between the pairs of card holders, such that the destination card holders holding the cards now act as source card holders and wherein the controller is arranged to conduct at least one further shuffling round during which the controller controls the conveying mechanism to distribute cards from a first of the card holders now acting as a source between the pair of card holders now acting as a destinations and subsequently distribute cards from a second of the pair of card holders now acting as a source between the pair of destination card holders.

In an embodiment, the controller is arranged to conduct an initial shuffling round during which one card holder is a source card holder and a pair of card holders are destination card holders, the controller controlling the conveying mechanism to distribute cards from the source card holder between the pair of destination card holders.

In an embodiment, subsequent to completion of the shuffling rounds, the controller controls the conveying mechanism to convey the shuffled cards to a further card holder from which they may be dealt.

In an embodiment, the controller is arranged to conduct sufficient shuffling rounds to make the arrangement of the cards conveyed to the further card holder random.

In an embodiment, the controller is arranged to conduct nine shuffling rounds including the initial shuffling round.

In an embodiment, a card feeding mechanism is associated with each card holder, each card feeding mechanism, adapted to feed individual cards to and from the respective card holder.

In an embodiment, the apparatus comprises a data structure storing shuffling data, and the controller controls movement of the cards based on the shuffling data.

In an embodiment, the controller is arranged to generate the shuffling data.

In an embodiment, the controller generates the shuffling data by associating a different plural digit number with each card, the controller employing the value of one of the digits to control a destination of each card in each shuffling round and employing different digits of the number in respective ones of a plurality of shuffling rounds.

In an embodiment, the shuffling apparatus comprises a card reader arranged to obtain identification data from each card prior to shuffling the cards, and wherein the controller associates the identification data with the plural digit number when generating the shuffling data.

In an embodiment, the card reader is a barcode reader adapted to read a barcode on each card.

In an embodiment, the shuffling apparatus comprises a further card reader arranged to obtain a card identification data after the card shuffling has been completed and wherein the controller is arranged to determine an expected card order based on the shuffling data, and to determine whether the cards are in the expected card order based on the card identification data obtained by the further card reader.

In an embodiment, the further card reader is a barcode reader adapted to read a barcode on each card.

In an embodiment, the further card reader is adapted to read cards as they are dealt from the further card holder.

In an embodiment, the further card holder is one of a pair of dealing card holders from which cards may be dealt.

In an embodiment, the pair of dealing card holders are mounted to be movable between a first position for receiving shuffled cards and a second position from which cards are dealt.

In an embodiment, the pair of dealing card holders are mounted for rotational movement around a common axis between the first and second positions.

In an embodiment, the conveying mechanism comprises a dealing portion viewable by players along which the cards are conveyed after being dealt.

In an embodiment, the shuffling apparatus comprises a card presentation mechanism associated with the dealing portion and controllable by the controller to move dealt cards from a non-viewable face down position to a viewable position.

In an embodiment, the card presentation mechanism is controllable by the controller to turn cards face up.

In an embodiment, the conveying mechanism is arranged to convey cards from the dealing portion to a card holder acting as a card return holder for receiving the dealt cards and holding them until they are shuffled again.

In an embodiment, the shuffling apparatus is arranged to shuffle cards of a second set of cards while dealing a first set of cards.

In an embodiment, the shuffling apparatus comprises at least six card holders, and four of the card holders act as shuffling card holders while the other two card holders act as a dealing holder and a card return holder.

In an embodiment, two of the card holders swap roles between being a shuffling card holder and a card return holder between shuffles of decks.

In an embodiment, the card holder and feeding mechanism are arranged to feed cards either from and to the bottom of a stack of cards in the card holder or from and to the top of a stack of cards in the card holder.

In an embodiment, the feeding mechanism comprises a plurality of driveable members, including at least two rollers or belts and wherein when a card is being fed by the feeding mechanism from a card holder at least one roller or belt is driven against the feed direction during at least part of the feeding to act to reject the feeding of more than one card simultaneously.

In an embodiment, the controller comprises a master controller and a plurality of sub-controllers arranged to control different parts of the shuffling apparatus.

In a second aspect, the invention provides a shuffling method comprising conducting one or more shuffling rounds wherein at least part of a shuffling round comprises:

- conveying cards from a source card holder to at least two other card holders acting as destinations with a conveying mechanism; and
- controlling the conveying mechanism to control the destination to thereby at least partially shuffle the cards.

In an embodiment, the conveying mechanism comprises at least one switching mechanism, and the controlling the conveying mechanism comprises controlling the at least one switching mechanism.

In an embodiment, the shuffling method comprises conducting at least one shuffling round during which one pair of card holders are source card holders and another pair of card holders are destination card holders by controlling the conveying mechanism to distribute cards from a first of the pair of source card holders between the pair of destination card holders and subsequently to distribute cards from a second of the pair of source card holders between the pair of destination card holders.

In an embodiment, the shuffling method comprises reversing roles between the pairs of card holders subsequent to distribution of the cards to the destination card holders such that the destination card holders holding the cards now act as source card holders and conducting at least one further shuffling round by controlling the conveying mechanism to distribute cards from a first of the card holders now acting as a source between the pair of card holders now acting as a destinations and subsequently to distribute cards from a second of the pair of card holders now acting as a source between the pair of destination card holders.

In an embodiment, the shuffling method comprises conducting an initial shuffling round during which one card holder is a source card holder and a pair of card holders are destination card holders by controlling the conveying mechanism to distribute cards from the source card holder between the pair of destination card holders.

In an embodiment, the shuffling method comprises conveying the shuffled cards to a further card holder from which they may be dealt subsequent to completion of the shuffling rounds.

In an embodiment, the shuffling method comprises conducting sufficient shuffling rounds to make the arrangement of the cards conveyed to the further card holder random.

In an embodiment, the shuffling method comprises nine shuffling rounds including the initial shuffling round.

In an embodiment, the shuffling method comprises controlling movement of the cards based on shuffling data.

In an embodiment, the shuffling method comprises generating the shuffling data by associating a different plural digit number with each card, employing the value of one of the digits to control a destination of each card in each shuffling round, and employing different digits of the number in respective ones of a plurality of shuffling rounds.

In an embodiment, the shuffling method comprises obtaining identification data from each card prior to shuffling the cards and associating the identification data with the plural digit number when generating the shuffling data.

In an embodiment, the shuffling method comprises obtaining the card identification data in a checking stage after the card shuffling has been completed, determining an expected card order based on the shuffling data, and determining whether the cards are in the expected card order based on the card identification data obtained in the checking stage.

In a third aspect, the invention provides a shuffling method for shuffling cards comprising:

- generating shuffling data by associating a different plural digit number with each card to be shuffled;
- conducting a plurality of shuffling rounds during which cards are moved from at least one source card holder to at least two destination card holders; and
- controlling the destination of each card based on the shuffling data by employing a different digit of the plural digit number in each shuffling round, allocating different possible values of the digit to different destinations, and controlling the destination based on the value of the relevant digit.

In an embodiment, there are two possible destinations for each card in a shuffling round wherein a nine bit number is allocated to each card and nine shuffling rounds are conducted.

In an embodiment, the shuffling method comprises obtaining a card identification identifying each card and associating the plural digit number with the card identification.

In an embodiment, the shuffling method comprises obtaining the card identification data again in a checking stage after the card shuffling has been completed, determining an expected card order based on the shuffling data, and determining whether the cards are in the expected card order based on the card identification data obtained in the checking stage.

In a fourth aspect, the invention provides a shuffling controller arranged to:

- generate shuffling data by associating a different plural digit number with each card to be shuffled;
- conduct a plurality of shuffling rounds during which cards are moved from at least one source card holder to at least two destination card holders; and control the destination of each card based on the shuffling data by employing a different bit of the plural digit number in each shuffling round, allocating different values of a digit to different destinations, and controlling the destination based on the value of the relevant digit.

In an embodiment, there are two possible destinations for each card in a shuffling round.

In an embodiment, a nine bit number is allocated to each card and nine shuffling rounds are conducted by the shuffling controller.

In an embodiment, the shuffling controller is adapted to receive a card identification identifying each card and associate the plural digit number with the card identification.

In an embodiment, the shuffling controller is adapted to receive the card identification data again in a checking stage after the card shuffling has been completed, determine an expected card order based on the shuffling data, and determine whether the cards are in the expected card order based on the card identification data obtained in the checking stage.

In a fifth aspect, the invention provides a shuffling and dealing method comprising:

generating shuffling data by associating a different plural digit number and identification data with each card to be shuffled;

shuffling the cards based on the shuffling data;

dealing the shuffled cards in a dealing order determined by obtaining identification data cards in the order in which the are or are to be dealt cards;

determining an expected dealing order from the shuffling data; and generating error data if the dealing order and expected dealing order do not match.

In a sixth aspect, the invention provides a shuffling and dealing controller arranged to:

generate shuffling data by associating a different plural digit number and identification data with each card to be shuffled;

control shuffling of the cards based on the shuffling data;

determine an expected dealing order from the shuffling data determined by obtaining identification data cards in the order in which the are or are to be dealt cards; and generate error data if the actual dealing order and expected dealing order do not match.

In a seventh aspect, the invention provides a feeding mechanism for a shuffling apparatus, the feeding mechanism arranged either to feed cards from and to the bottom of a stack of cards held by a card holder or from and to the top of a stack of cards held by a card holder, the feeding mechanism comprising a plurality of driveable members, including at least two rollers or belts and wherein when a card is being fed by the feeding mechanism from a card holder at least one roller or belt is driven against the feed direction during at least part of the feeding to act to reject the feeding of more than one card simultaneously.

In an embodiment, the drive members comprise at least two rollers.

In an embodiment, the feeding mechanism is arranged to feed cards from and to the bottom of the stack and including at least one lower roller and at least one upper roller and wherein when a card is being fed by the feeding mechanism from a card roller at least one upper roller rotates against the feed direction.

In an eighth aspect, the invention provides a gaming apparatus for card games comprising:

a shuffling and dealing apparatus arranged to conduct a shuffling and dealing process in which cards are shuffled and dealt in a manner in which the dealt cards are physically displayed to a player;

at least one display adapted to display representations of cards; and a controller adapted to control the at least one display to display representations corresponding to the physical display of cards to one or more players.

In an embodiment, the controller is arranged to control the shuffling and dealing apparatus to physically display either the face or the back of a card in accordance with the rules of the card game for which cards are being dealt.

In an embodiment, the shuffling and dealing apparatus comprises a conveying mechanism comprising a dealing portion along which cards are dealt and displayed before being returned to the shuffling apparatus by the conveying mechanism.

In an embodiment, the conveying mechanism comprises a face down card holding area for holding face down cards while other cards are dealt.

In a ninth aspect, the invention provides a gaming method comprising:

shuffling and dealing cards with an automatic shuffling and dealing apparatus;

physically displaying each card to a player as it is dealt; and controlling at least one display to display virtual representations of cards corresponding to the physical display of cards.

In an embodiment, the method comprises physically displaying either the face or the back of a card in accordance with the rules of the card game for which cards are being dealt.

In an embodiment, the method comprises dealing and displaying the cards along a dealing portion of a conveying mechanism before returning the cards to the shuffling apparatus by the conveying mechanism In an embodiment, the method comprises holding face down cards in a face down card holding area while other cards are dealt.

In a tenth aspect, the invention provides a continuous loop shuffling apparatus comprising a plurality of card holders;

a conveying mechanism including a dealing portion along which the cards are physically displayed to players; and a controller arranged to:

shuffle a set of cards employing the card holders;

deal the cards along the dealing portion;

return the set of cards to a card holder acting as a return card holder by the conveying mechanism;

reshuffle the cards; and deal the cards again.

In an embodiment, the continuous loop shuffling apparatus is adapted to shuffle and deal a further set of cards such that there are first and second sets of cards, the first set being dealt while the second set is shuffled and the second set being dealt while the first set is shuffled.

In an eleventh aspect, the invention provides a dealing apparatus comprising:

a dealing mechanism arranged to deal cards face down; and a card presentation mechanism operable to move a dealt card from a face down position to a viewable position where the card's face is intended to be viewable by a player.

In an embodiment, the dealing apparatus comprises a controller arranged to control the card presentation mechanism to move dealt cards to the viewable position.

In an embodiment, in the viewable position cards are face up.

In an embodiment, the dealing apparatus comprises a conveying mechanism for conveying cards from the dealing mechanism to the card presentation mechanism.

In an embodiment, the dealing apparatus comprises a held card holding area, and wherein the conveying mechanism is arranged to convey cards which have not been moved to a viewable position to the held card holding area.

In an embodiment, the card presentation mechanism comprises a pair of pivotable arms each having a card cage at a distal end thereof, the card presentation mechanism being controlled such that cards are dealt alternately into the card cages of respective ones of the pair of arms such that one of the arms displays a card in the arm's card cage while the other of the arms receives a card in the arm's card cage.

In a twelfth aspect, the invention provides a dealing method comprising:

dealing cards face down with a dealing mechanism; and controlling a card presentation mechanism to selectively display the face of dealt cards to one or more players.

In an embodiment, in the viewable position, cards are face up.

In an embodiment, the dealing method comprises conveying cards to a held card holding area which have not been moved to a viewable position.

In an embodiment, the dealing method comprises dealing cards alternately into card cages of respective ones of a pair of pivotable arms, the card cages being located at the distal ends of each arm such that one of the arms displays a card in the arm's card cage while the other of the arms receives a card in the arm's card cage.

In a thirteenth aspect, the invention provides a playing card comprising a barcode located in at least one corner of a face side of the card, the barcode identifying the card and the deck of cards to which it belongs.

In an embodiment, the barcode is a two-dimensional bar code.

In a fourteenth aspect, the invention provides a processing apparatus for processing data carrying substrates, the processing apparatus comprising:

at least three data carrying substrate holders, each adapted to hold a plurality of data carrying substrates;

a conveying mechanism adapted to convey data carrying substrates between each data carrying substrate holder and at least two other data carrying substrate holders, the conveying mechanism controllable to select a destination data carrying substrate holder of the at least two data carrying substrate holders; and a controller arranged to control the conveying mechanism in to selectively control the destination data carrying substrate holder to which data carrying substrates are sent.

In an embodiment, the conveying mechanism comprises at least one switching mechanism controllable by the controller to control the destination.

In an embodiment, the controller is also arranged to control the conveying mechanism in a moving mode in which data carrying substrates are sent between one source data carrying substrate holder and one destination data carrying substrate holder.

In an embodiment, a feeding mechanism is associated with each data carrying substrate holder, the feeding mechanism, adapted to feed individual data carrying substrates to and from the data carrying substrate holders.

In an embodiment, the feeding mechanism comprises a plurality of driveable members, including at two rollers or drive belts and wherein when a data carrying substrate is being fed by the feeding mechanism from a data carrying substrate holder at least driveable member is driven against the feed direction during at least part of the feeding to act to reject the feeding of more than one data carrying substrate simultaneously.

In an embodiment, the controller is arranged to control the destinations based on processing data.

In an embodiment, the processing apparatus comprises a data carrying substrate reader arranged to obtain identification data from each data carrying substrate prior to processing and to generate processing data by associating the identification data with a plural digit number, individual digits of the plural digit number specifying respective ones of a plurality of possible destinations during a plurality of processing passes.

In a fifteenth aspect, the invention provides a processing method comprising conducting one or more processing passes wherein at least part of a processing pass comprises:

conveying data carrying substrates from a source data carrying substrate holder to at least two other data carrying substrate holders acting as destinations with a conveying mechanism; and controlling the conveying mechanism to control the destination to thereby at least partially process the data carrying substrates.

In an embodiment, the conveying mechanism comprises at least one switching mechanism and the method comprises controlling the at least one switching mechanism to control the destination.

In an embodiment, the processing method comprises controlling the destinations based on processing data.

In an embodiment, the processing method comprises obtaining identification data from each data carrying substrate prior to processing and generating processing data by associating the identification data with a plural digit number, individual digits of the plural digit number specifying respective ones of a plurality of possible destinations during a plurality of processing passes.

BRIEF DESCRIPTIONS OF THE DRAWINGS

Embodiments of the invention will now be described by way of example, in relation to the accompanying drawings in which.

Figure 5A:
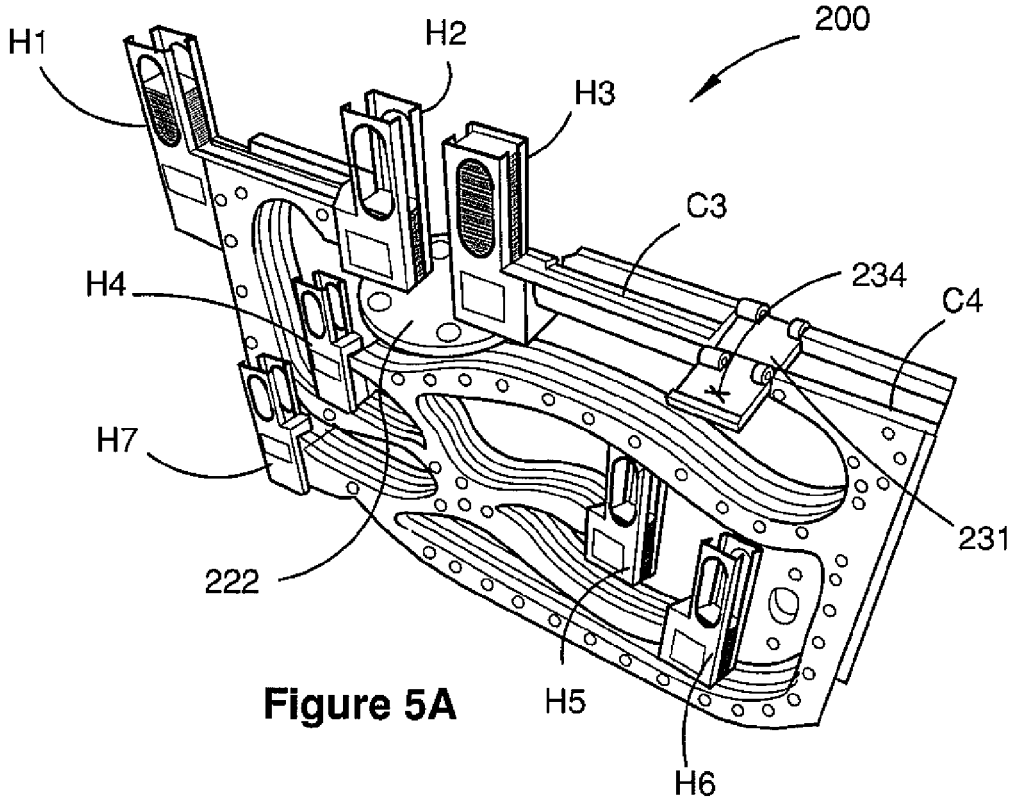
Figure 5B:
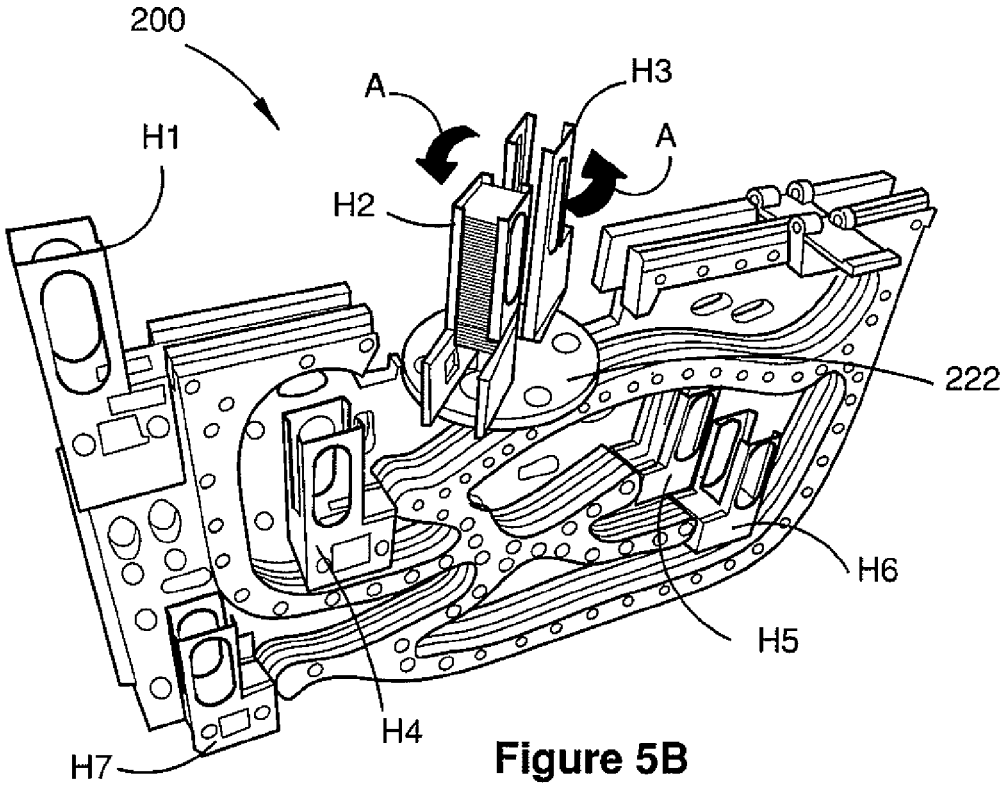
Figure 6:
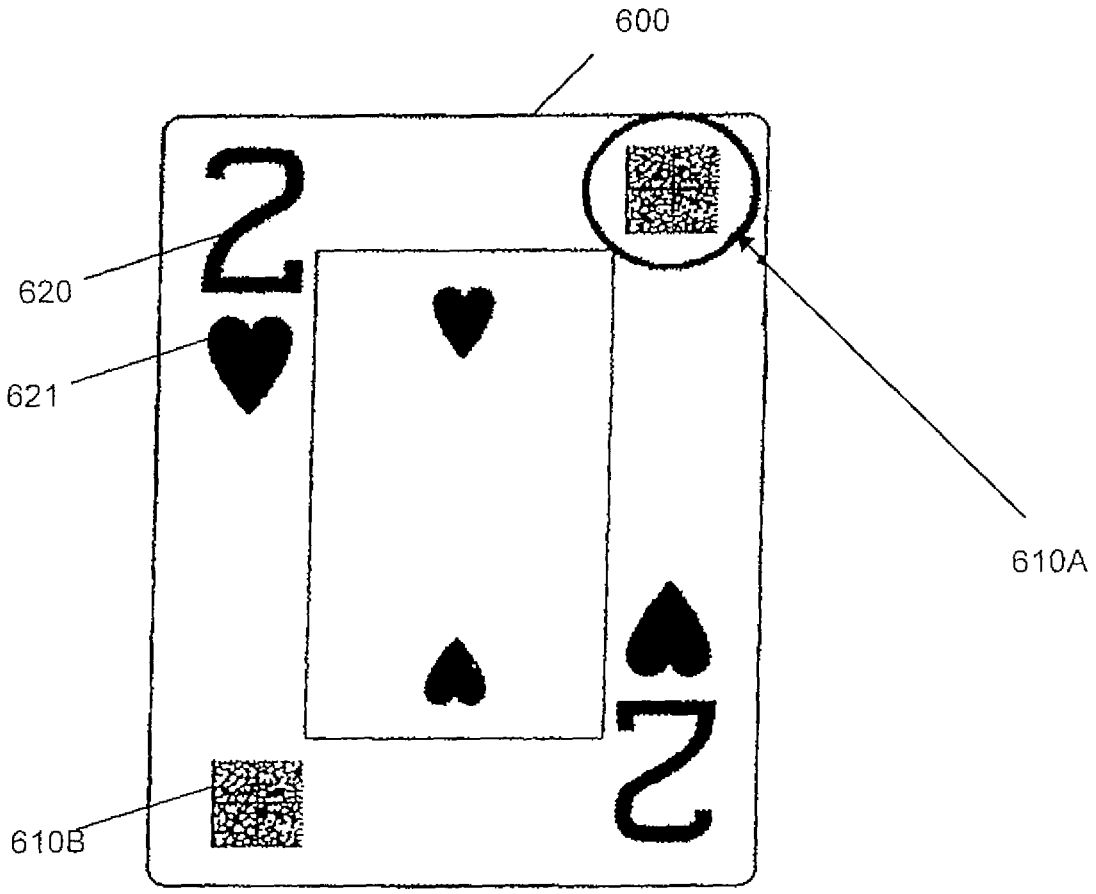
Figure 8:
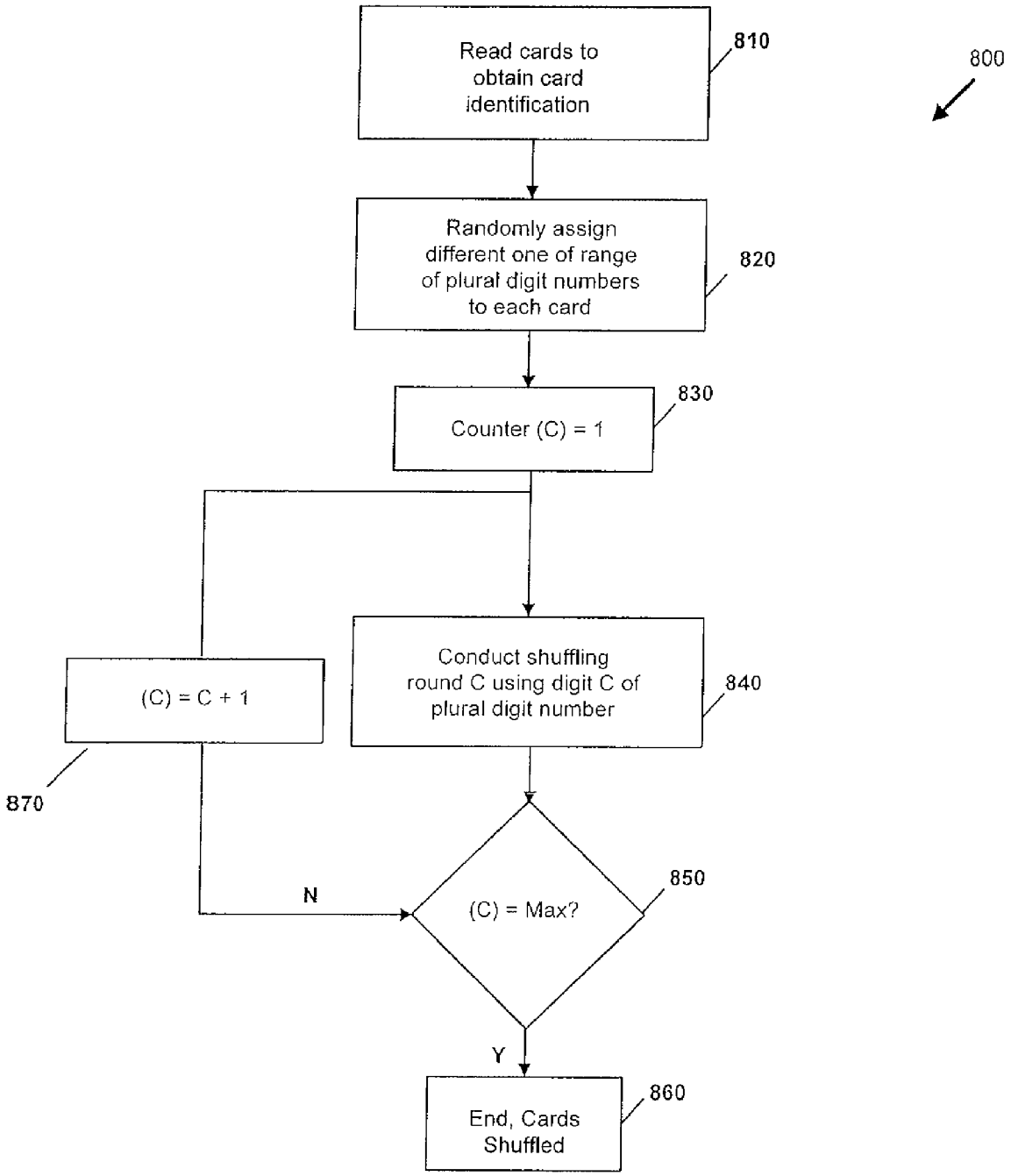

FIGS. 5*a* and 5*b* are perspective views of the shuffling apparatus;

FIG. 6 shows an exemplary card;

FIGS. 7*a* to 7*d* show examples of cards being dealt in accordance with an embodiment of the invention;

FIG. 8 is a flow chart a method of an embodiment; and

FIG. 9 shows an exemplary allocation of codes to card values.

DETAILED DESCRIPTION

The drawings show a shuffling apparatus which can form part of a gaming system for implementing a card game such as black jack. However, the apparatus could be readily adapted to other card games such as poker or baccarat.

The shuffling apparatus has a number of features which are brought together in a single apparatus and gaming system to provide a highly sophisticated shuffling apparatus. However, a person skilled in the art will appreciate that various aspects of the shuffling apparatus could be employed in other apparatus or indeed for different applications, in particular sorting applications, as will be discussed in more detail below. A person skilled in the art will thus, recognise that alternative embodiments may be derived which either employ only parts of the shuffling apparatus or employ components in different combinations.

Overview of Gaming System Employing Shuffling Apparatus

Figure 1:
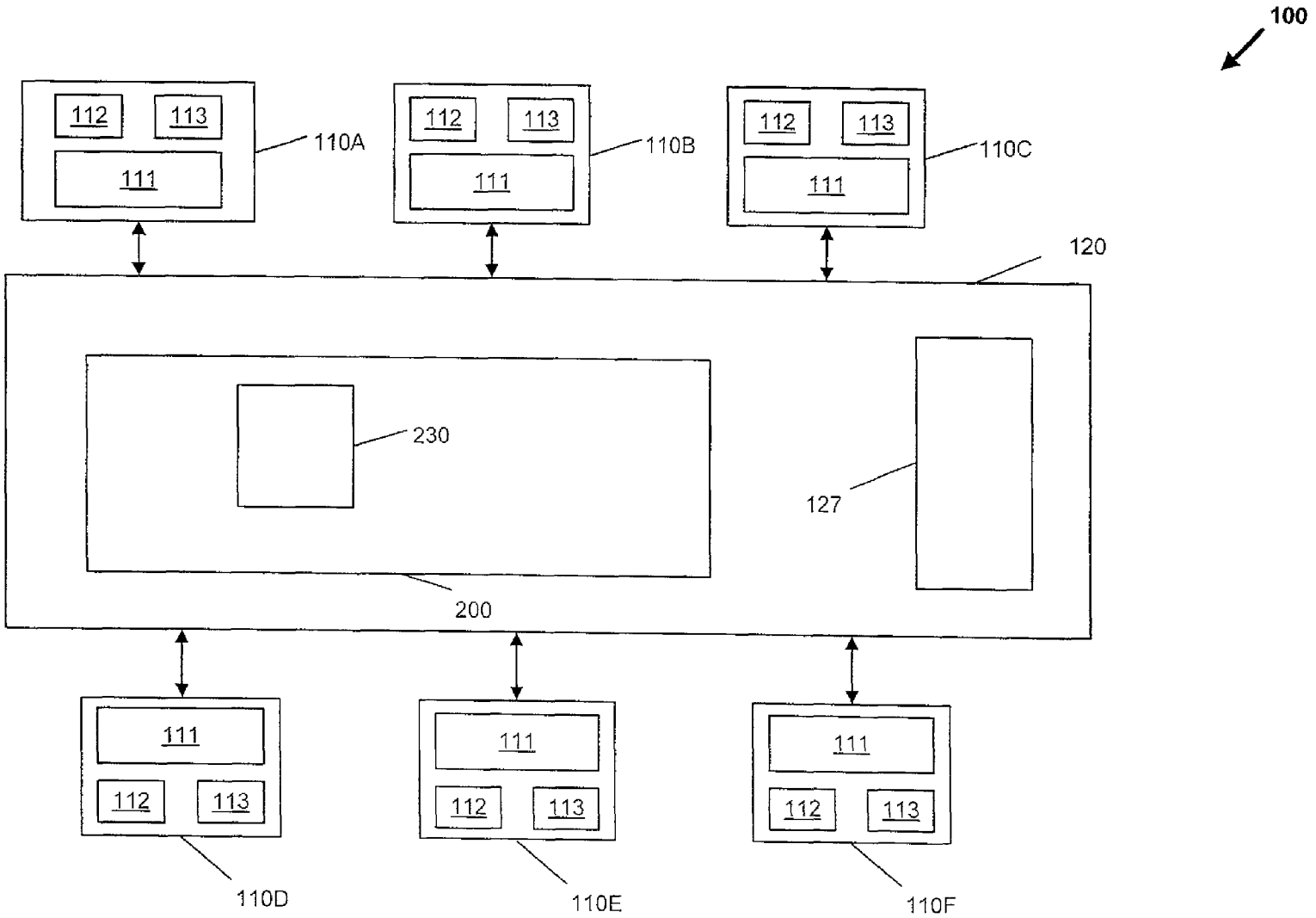
FIG. 1 is a block diagram of gaming system employing the shuffling apparatus.

Referring to FIG. 1, there is shown schematically a gaming system 100 comprising a shuffling apparatus 200. As will be apparent from the following description, the shuffling apparatus 200, can also deal cards and hence is actually a shuffling and dealing apparatus, however for convenience the shuffling and dealing apparatus is referred to herein as a shuffling apparatus.

As illustrated in FIG. 1, the shuffling apparatus 200 is mounted within a gaming table 120. The gaming table has a display 127 mounted at one end thereof. A plurality of gaming terminals 110 operable by individual players are arranged around the gaming table 120. The gaming system 100 is arranged such that cards dealt by the shuffling apparatus for the players are physically displayed by card presentation mechanism 230 and also displayed on the displays 111 of the player terminal 110 to which the cards belong. The dealer's cards are displayed on display 127.

Each player terminal also includes a credit input mechanism 112, and an instruction input mechanism 113 which is operable by the player in order to make decisions about how to play the game, e.g. to place bets, select cards, request further cards or whatever else is required to play the game. Accordingly, one feature of the gaming system is that cards which are physically displayed as dealt by the card presentation mechanism 230 of the shuffling apparatus 200 are also displayed on a player's display 111 or the main display 127. This has the advantage relative to purely electronic games that a player can see the cards as they are dealt and does not need to rely solely on the electronic representation of cards. That is, there is a link between the cards displayed on displays 111, 127 and the actual physically presented cards.

A further advantage is that the cards are maintained within the shuffling apparatus (even though they are physically displayed), and therefore are not subject to tampering and do not require dealing by a human dealer.

Figure 2:
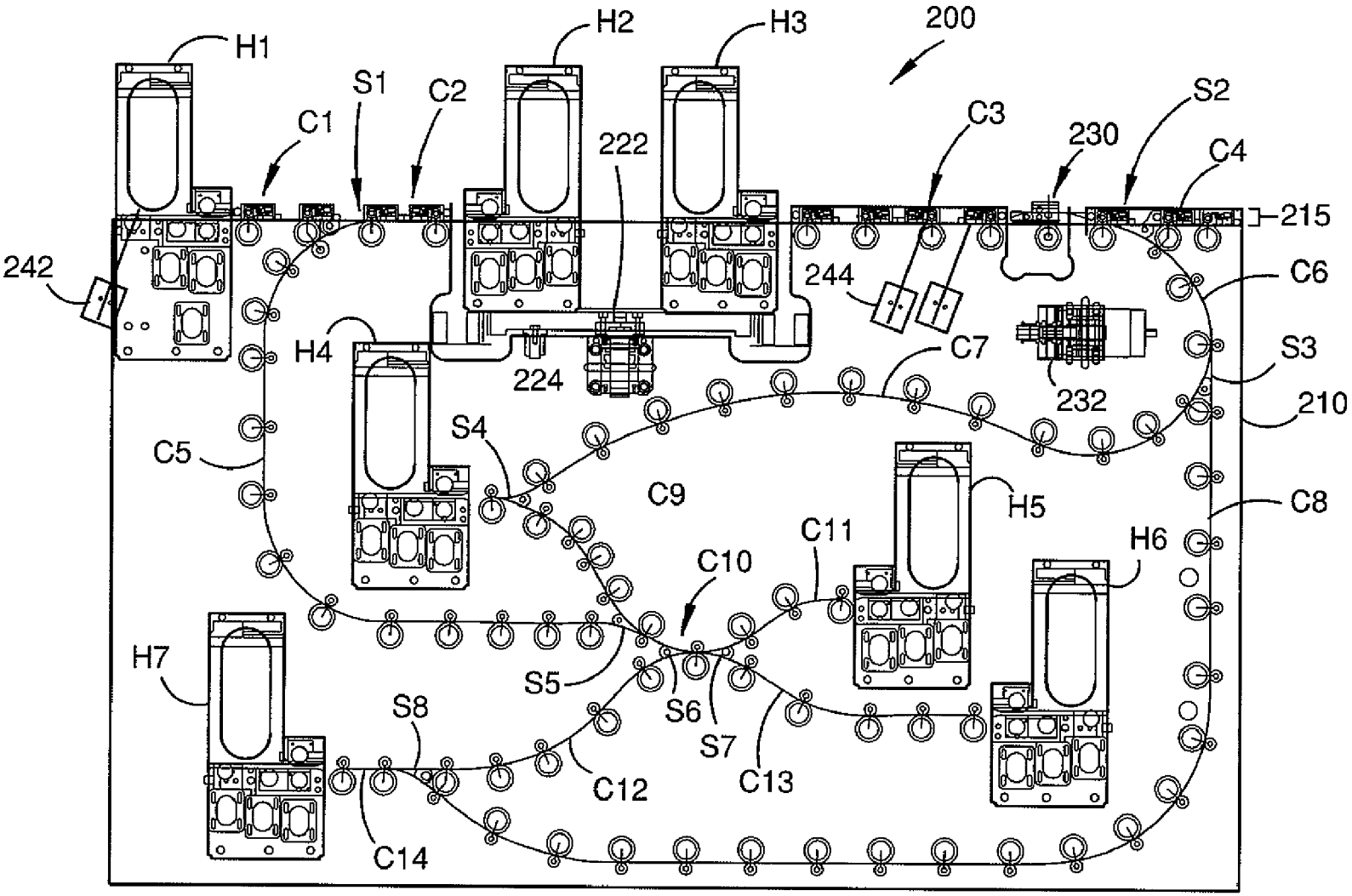
FIG. 2 is a side view showing the conveying mechanism of the shuffling apparatus.

Referring to FIG. 2 the shuffling apparatus 200 is shown in further detail. The shuffling apparatus 200 has seven card holders H1-H7 each having a chute for holding cards and a card feeding mechanism. The shuffling apparatus also has a conveying mechanism which has a plurality of conveying sections C1-C14 and a plurality of switches S1-S8. Parts of a conveying mechanism (indicated by 215) are exposed from the housing 210 so as to be viewable or partially viewable by the player.

The dealing and shuffling mechanism will be described in further detail below but in general cards are input to card holder H1, shuffled using a combination of card holders H2, H4, H5, H6 and H7 and dealt from card holder H3 before being physically presented by card presentation mechanism 230.

Card holders H2 and H3 are mounted to a turntable 222 which rotates around a central pivot point 224. In this way, after cards have been shuffled, they can be delivered to card holder H2 which is then rotated by turntable 222 to the position occupied by card holder H3. In this application, while card holders H2 and H3 will be exchanged from time to time, the card holder that is currently in the position of H2 is always referred to as card holder H2 and the card holder which is currently in the position of H3 is always referred to as card holder H3, except when describing a change of positions.

There are a number of other components mounted within the housing 210 including a first barcode reader 242 arranged to read cards as they are input via card holders H1 and a second barcode reader 244 arranged to read cards as they are dealt. This is described in further detail below. FIG. 2 also shows the drive mechanism 232 for the card presentation mechanism 230.

Figure 3:
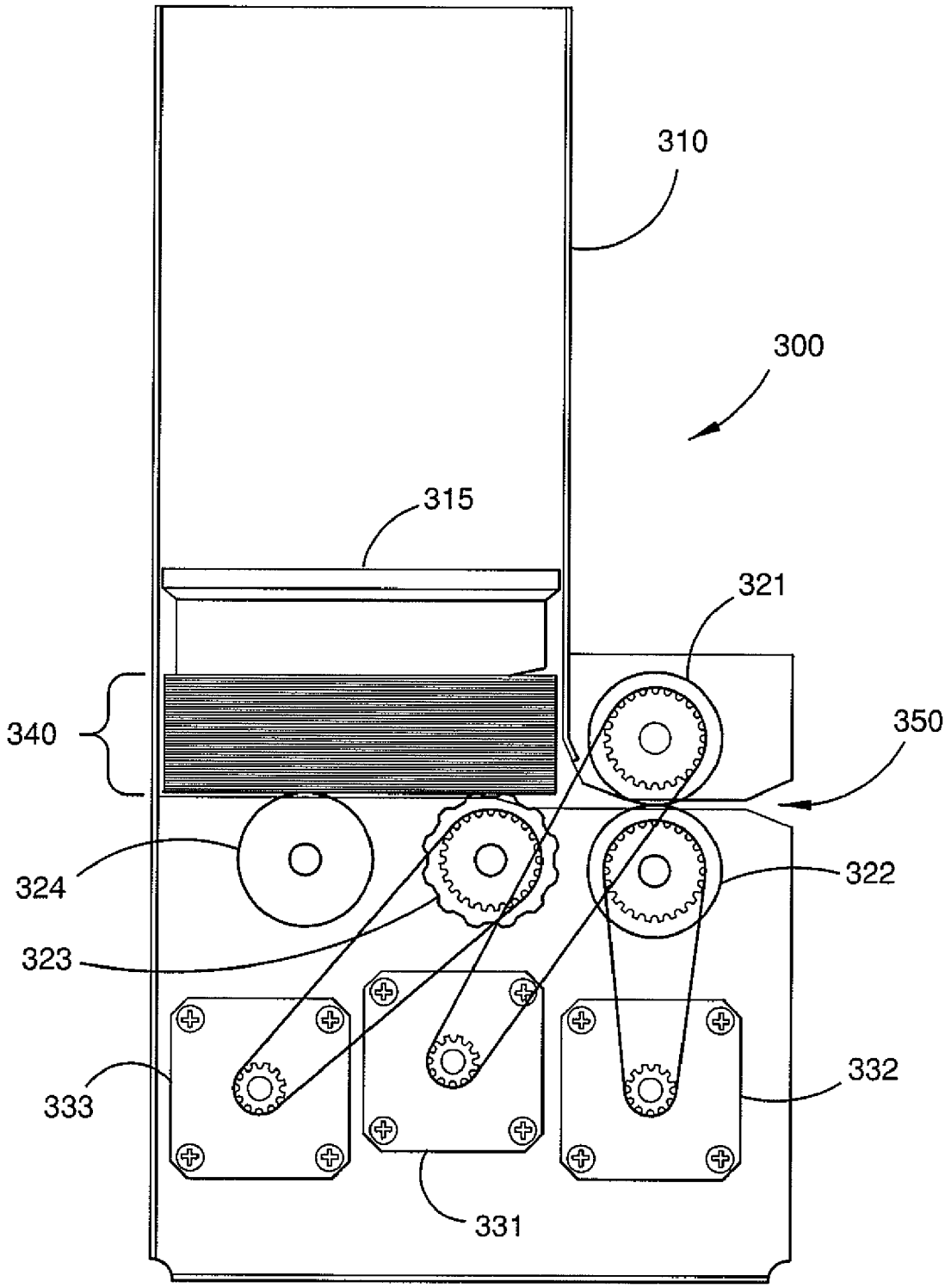
FIG. 3 is a side view of a card chute.

Referring to FIG. 3, there is shown the structure of a single card holder. Cards are fed in and out of aperture 350 by a feeding mechanism having rollers 321, 322, 323 which are driven by respective ones of stepper motors 331 to 333. The cards are supported between wedge 315, support roller 324 and card pick off roller 323. The chute 310 is capable of receiving eight decks of playing cards. A person skilled in the art will appreciate that the chute 310 can be adapted to receive whatever the required number of decks to implement the game.

In operation in order to output a card from the card holder 300, the pick off roller 323 rotates clockwise by preset speed. The upper pinch roller 321 is driven clockwise with preset torque and rotates anti-clockwise following the output card or rotates clockwise returning the next output card if jammed on top of output card. The lower pinch roller 322 is driven clockwise by preset rotating speed. The aperture 350 and the gap between lower pinch roller 322 and upper pinch roller 321 are self-adjusting to accommodate the thickness of the cards.

In the return process, cards are held in the conveying mechanism and then delivered by the conveying mechanism to the pinch rollers 321, 322 which drive it to the bottom of the stack of cards 340 with help of pick off roller 323. That is, cards are removed from the bottom of the stack and fed to the bottom of the stack.

Persons skilled in the art will appreciate that the position of the same feeding mechanism could be used with different stack orientations, for example if cards were dealt off the top of the deck and hence that the position of the feeding and separation roller is stack of cards orientation dependant. Similarly, the rollers could be replaced with another drive member, for example, with belts.

All the control logic for the card holder 300 is embedded on a local Programmable Logic Circuit (PLC) (not shown) such that a central controller, as will be described in more detail below need only instruct the card holder to output or input a card and the local controller embodied by the PLC controls the motors 331 to 333 to carry out the input or output process. Accordingly it would be appreciated that the card holder has a feed mechanism formed by the rollers 321 to 324 and aperture 350 for feeding cards to and from the conveying mechanism formed by conveying sections C1-C14 and switches S1-S8 as will be described in further detail below.

FIGS. 5*a* and 5*b* use the same nomenclature as FIG. 2 but allow better views of some aspects of the shuffling apparatus. In particular FIG. 5*a* shows the card presentation mechanism 230 which comprises a pair of cages 231, 234 mounted on arms driven by motor 232. The cages are designed such that cards can be driven into and out of them via the conveyor mechanism C3, C4 and they can alternatively be pivoted such that one is in a card receiving/card removal position as illustrated by cage 231 in FIG. 5*a* and the other of the cards is in the card presentation position as indicated by cage 234. That is, at the card presentation mechanism, cards are presented by turning them from face down to face up. A person skilled in the art will appreciated that if player positions were on one side, this could be achieved by pivoting the cards to a vertical position. FIG. 5*b* illustrates holders H2 and H3 being rotated by turntable 222 as indicated by arrows A in order to exchange the positions of H2 and H3.

As described above, the cards are read as they input to the shuffling apparatus and dealt by the shuffling apparatus. Accordingly, in this embodiment the card readers are barcode readers adapted to read barcodes placed in the corners of the cards. A person skilled in the art will appreciate that other techniques could be employed including capturing images of the card and employing image recognition software in order to determine the nature of the card. However, the use of barcodes is convenient as described in further detail below as it readily allows a unique serial number to be allocated to each deck of cards in order to prevent cards from different decks being infiltrated into the game. FIG. 6 shows one exemplary card 600. As with conventional cards the card bears the number 620 and suit designator 621. However, in addition, a pair barcodes 610*a*, 610*b* are placed in the corners. The barcodes 610*a*, 610*b* are two-dimensional barcodes. Such barcodes: 1) allow more information to be carried; or 2) can contain more redundant information in order to make them easier to read and interpret. In the preferred embodiment, the barcode consists of thirteen digits and contains card value information, a serial of the deck unique to each deck and a control number: Two digits of the number are for the card code; two digits are reserved for future use (initially set as 00); an eight digit serial numbers is supplied for the manufacturer; and a signal bit is used as a control number, for example as a check sum of the other numbers.

FIG. 9 shows a typical card value chart 900 where individual values are assigned for each card 910 for each suit 920. For example, the number 20 (card value) is assigned to the seven of spades.

Initial Processing of Cards

The initial feeding of cards is from holder H1 to H2 using conveyor portion C1 and C2. Cards are gathered into holder H2 and retained there until the eight decks that have been input into card holder H1 have been validated and all processing is completed which is required prior to shuffling. In this way, should any validity checking lead to identification of an error in the cards, they can be removed from holder H2 before being input into the interior of the gaming machine. In this way, players can see that cards are not fed into the interior of the machine for shuffling until their validity has been checked. Once the cards have been validated by checking, for example that the decks have not been used previously and contain no missing cards or extra cards, shuffling commences.

Figure 4:
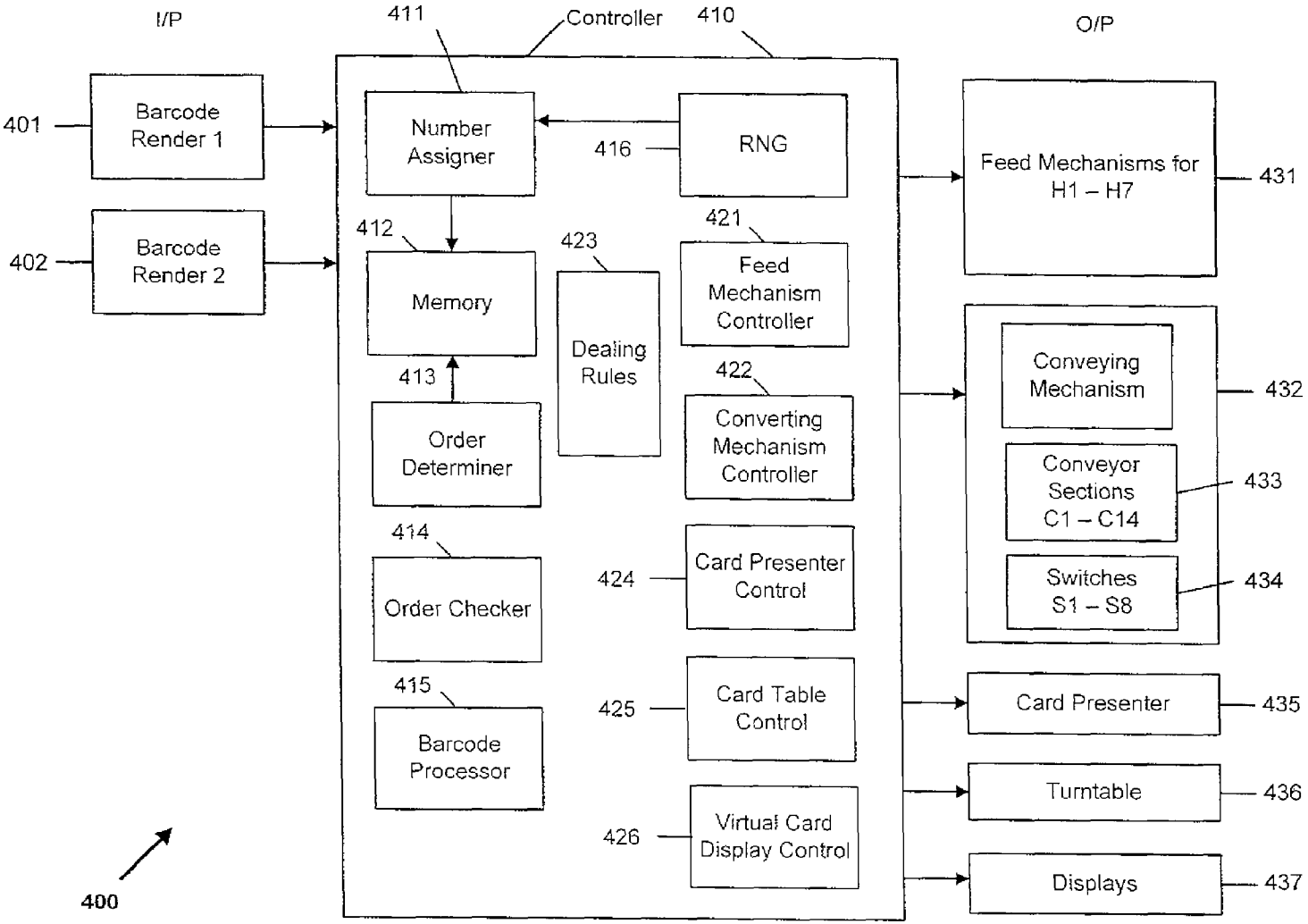
FIG. 4 is a functional block diagram of the shuffling apparatus.

A functional block diagram 400 of the shuffling apparatus is shown in FIG. 4. The shuffling apparatus has a shuffling and dealing controller 410 for carrying out the shuffling algorithm. The controller 410 is typically embodied by a series of software modules executed by a processor of a dedicated personal computer. A person skilled in the are will appreciate that the controller 410 can be embodied using any appropriate software/hardware combination and will contain relevant processing power and sufficient memory to carry out its functions and will include normal features of a computer such as an operating system, input and output and the like. A person skilled in the art will appreciate that various functions could be distributed over a number of different computers. For example, the use of serial numbers as described above is intended to prevent repeat use of decks of cards. That is that decks of cards will be discarded or destroyed after they have been used. Used serial numbers can be stored in a data structure such as a table in memory 412 of the shuffling apparatus. However, in practice in a casino there may be a number of shuffling apparatus and accordingly it may be convenient to store the identity of used decks of cards centrally on a server and rather than the controller consulting the memory 412, the controller 410 could send a request for validation of the card deck serial number to a server. It will be appreciated that this is essentially the same as checking against data stored in a data structure in memory 412.

Accordingly as cards are read the numbers obtained by a first barcode reader 242 as represented in the functional block diagram as element 401 are supplied to the controller. The barcode processor 415 interprets the data from the barcode reader and supplies the interpreted data to the number assigner 411. The number assigner 411 is arranged to assign a unique number from a set of plural digit numbers to each card employing the random number generator 416. In the case of eight decks, the controller needs to assign one of 416 unique numbers to each card. In the shuffling algorithm employed in the invention, in each shuffling round cards are moved from one card holder to acting as a source to two card holders acting as destination to complete at least part of a shuffling round. Accordingly, as there are two destinations, a binary digit is sufficient to uniquely map the destination and hence a nine digit binary number meets the criteria. Different digits of each assigned number are used to control further shuffling rounds as will be described in further detail below. As the numbers are assigned, they are stored as shuffling data in a data structure in memory 412. Once the numbers have been randomly assigned, it is possible to determine the order in which they should be dealt from card holder H3 based on the known shuffling algorithm and hence that order can be checked by an order checker function 414 based on data supplied by barcode processor 415 from the second barcode reader 244 as represented in FIG. 4 by barcode reader 2 402.

Thus, while the numbers are randomly assigned to the cards by the number assigner 411 employing the random number generator 416, the ultimate order can be determined by the auditor terminal 413 and stored in memory 412 for checking by the order checker 414.

The controller 410 then controls the apparatus based on the shuffling data—i.e. the feed mechanisms with a feed mechanism controller 421, the conveying mechanism of conveying mechanism controller 422, the card presenter 230 with the card presenter controller 424, and the turntable with the turntable controller 425 in order to shuffle and deal the cards. That is, the controller is operable to control the feed mechanism 431, the conveying mechanism 432 which consist of the conveying sections C1-C14 and the switches S1-S8 as well as the card presenter 435 and the turntable 436. These are all controlled based on the shuffling data in memory 412 and the dealing rules 423 for the game implemented by the shuffling apparatus 200.

In addition, the controller 410 includes a virtual card display control 426 which causes each card which is physically presented by the presentation mechanism 230 to be displayed on the relevant one of displays 437.

It should be noted at this point, that the card presentation mechanism 230 is selectively operable so that if it is not intended for a card to be displayed at a particular in point in time in the game, the card can be fed to card storage area C4 of the conveyor. In the illustrated embodiment of FIG. 2, the apparatus 200 is arranged to conduct a black jack game and accordingly the storage area C4 is arranged to hold only a single card belonging to the dealer, being the only card that is dealt face down in this particular embodiment of Black Jack.

Although it will be appreciated that in some Black Jack games a dealer's face down card is not dealt until after all the players have either stood or bust.

Shuffling Algorithm

The shuffling algorithm is described in more detail in relation to the flow chart 800 of FIG. 8. The cards are read 810 to obtain a card identification. The method then involves randomly assigning a different one of array of plural digit numbers to each card 820. The number of digits assigned to each card should be sufficient to uniquely identify each card such that each card will be shuffled differently to each other card and to designate the number of destinations that are used in each shuffling round: this also allows the card dealing order to be predicted. Further, there should be sufficient digits to allow for plural shuffling rounds. However, persons skilled in the art will appreciate that alternate shuffling algorithms can be used with the same or similar mechanical arrangements.

For example, it would be possible to use a base-3 (ternary) numeral system for assigning it to the cards. In that case, each digit could have 3 different values, and hence only 6 digits would need to be used to identify the card. The cards could therefore be sorted using only 6 iterations, but instead of two destination card holders, using ternary numeral system would require three destination card holders.

The process could therefore easily use base-4, base-etc, which would be assigned to the cards, however to have each number correspond to a unique destination more stackers would be needed for the sorting, but the number of iterations needed to complete the process would decrease. In other embodiments, more than one number may correspond to a single destination.

A counter in memory 412 is then set to one 830 to indicate that the first shuffling round is to be conducted. A first shuffling round is conducted using the first digit of the plural bit number 840. In the case of the nine bit binary number above, this would be the least significant bit. It is then determined whether C=the maximum value—i.e. the expected number of shuffling rounds 850 and if it is the process ends with the cards shuffled 860. If C≠ to the maximum value then the counter is increased 870 and the next shuffling round C=C+1 is conducted using digit C of the plural bit number. For example, the second least significant bit of the plural bit binary number. The process continues until all the shuffling rounds have been conducted.

Persons skilled in the art will appreciate that a number of alternate shuffling rules may be used. For example, any number of bits can be defined for the shuffling or numbers of other multi-digit numbers types can be used. Further a single value need not be allocated to each destination—i.e. more than one value can be allocated to a location.

Shuffling

As indicated above the binary numbers are used to select the designation of cards that are being shuffled. Accordingly, in each shuffling round, cards will be moved from a source to one of two different destinations as designated by the value of the bit, i.e. '0' will be allocated to a destination and "1" allocated to another destination. The destinations respective correspondence to bit values are stored in the memory 412.

It will be appreciated that after some shuffling rounds the cards will then be in two separate card holders—i.e. the destinations to which they were sent previously. It would be possible to move all those cards to a single card holder before shuffling again while maintaining the shuffle order. However, this requires additional movement of the cards and according it is preferred to conduct subsequent rounds shuffle the cards by moving them from two holders to two holders. In effect, this is a first partial shuffling round from a first holder to two destinations and a second partial shuffling round from the second source to the two destinations. Persons skilled in the art will also appreciate that more than two holders could be used in a shuffling round, for example cards could be sent to 3, 4, 5 or more destinations if this were desired and the number of card holders in the apparatus could be adjusted to accommodate such a technique.

Accordingly, while shuffling can be completed using just three card holders, four card holders are used for shuffling and the other three card holders used for other functions. In particular card holder H1 is always reserved for receiving cards such that cards are not dispatched within the housing 210 before being validated. H3 will be available for dealing. The final card holder is used for gathering dealt cards—i.e. holders H2, H4, H5, H6 and H7 are used for shuffling with the remaining holder being used to gather cards once they have been dealt from H3 for subsequent use.

In the following description, the sections of the conveying mechanism C1-C14 and switches S1-S8 that are used will be described until describing the path along which cards are sent becomes repetitive. In subsequent iterations only the destination holders are described.

First Card Set Shuffle

As indicated above cards are initially sent from holder H1 via C1 and C2 to holder H2. Once the cards have been validated, they are then sent from H2 to either H5 and H6 based on the least significant bit. Accordingly, cards travel along C5 until they reach the switches section of the conveyor in the mechanism marked by C10 where they are switched using switch S7 between conveyor section C11 which leads to holder H5 and conveyor section C13 which leads to holder H6. Accordingly, at the end of the shuffling round each of H5 and H6 will hold half the set of cards because the least significant bit of the 416 binary numbers that are assigned to the cards will have 213 occurrences of zero and 213 occurrences of 1 if 416 consecutive binary numbers are assigned to the set of cards. It will be appreciates that dividing the cards evenly is convenient but not essential. The controller then controls a second shuffling round in which cards are moved from H5 moving along C11 until they reach switching section C10 of the conveyor mechanism from where they are directed by switch S6 to either travel along C9 to H4 (i.e. for this shuffling round S5 is always switched towards C9) or they are directed along conveyor section C12 and C14 to a H7.

Similarly cards held in holder H6 are conveyed along section C13 and switched by switch S6 to either go along path C9 or C12 to holders H4 and H7 respectively.

Cards are then removed from H4 and sent along C9 and switched by switch S7 to either C11 or C13 to holders H5 and H6 respectively. Similarly, cards are moved from H7 along conveyor belt section C14, C12 through switching section C10 and along either C11 or C13 by controlling switch S7 to holder H5 or H6.

The process then involves a number of repeat shuffles based on the next most significant bit in the sequence so that in turn the cards are sent from H5 and H6 to H4 and H7, H4 and H7 to H5 and H6 then twice more each from H4 and H7 to H5 and H6, and from H5 and H6 to H4 and H7 respectively such that after nine shuffling rounds the cards are held in H5 and H6. From H5 and H6 the cards are moved firstly from H5 along a C11 by operating switches S6 and S5 to move them along conveying sections C5 and C2 into holder H2. The cards are then moved from holder H6 along C13 by operating switches S6 and S5 through switching section of C10 along conveyor section C5 and C2 into H2 such that the cards that were in H6 are in the stack of cards below the cards from H5 within H2. H2 and H3 are then swapped.

Cards can then be dealt from H3. The dealing of cards will be described in relation to a example below but in general cards are dealt along C3 to the card presentation mechanism 230 where they are either displayed by pivoting a cage 231, 234 to a face up position or they are passed face down to position C4 where they are held for later use in the game. From the presentation mechanism 230 cards are returned via conveyor section C6 and under control of switch S3 along conveyor section C8 and C14 to H7 where they are held for subsequent use. Any cards from C4 are eventually taken back from conveyor section C4 to presentation mechanism 230 from where they are conveyed along the same path to holder H7. It will be appreciated then that once all cards have been dealt from H3 they will be located in H7. A person skilled in the art will appreciate that not all cards from H3 need be dealt in actual game play but for example once only 20% of the cards remain these could all be dealt to holder H7. Such an action can be used to counteract benefits that might be obtained by card counting.

Second Card Set Shuffle

The embodiment is adapted to shuffle a second set of cards while the first set of cards is being dealt from holder H3. It will be appreciated that because holder H7 is being used to receive the first set of cards, it cannot be used in the shuffling of the second set of cards. Accordingly holder H2 replaces holder H7 in its role as a source and destination card holder in the shuffling. Thus in the shuffling of the second set of cards, cards are initially dealt from H2 to H5 and H6 and then sent from H5 and H6 to H2 and H4. Cards are then sent from H2 and H4 to H5 and H6 and the process repeats with cards finishing in holders H5 and H6 from where they are moved to holder H2.

When all cards are dealt from H3, H2 and H3 are swapped and cards from the second set of cards can be dealt. It will be appreciated that at this point in time the cards from the first set of decks of cards are in holder H7. Accordingly, cards dealt from the second set cannot be returned to H7 are instead returned by operating switch S3 along conveyor section C7 to card holder H4.

Reshuffling the First Set of Cards

The set of cards held in H7 can then be re-shuffled. Noting that the order is already known, i.e. the cards have read by barcode reader 244 prior to being passed to the interior and accordingly, the card reader knows the initial state of the cards, the same random assignation process described above can be used in order to assign new nine bit numbers to the cards in H7. A person skilled in the art will appreciate that the invention could be adapted by adding a further barcode reader to check the cards as they are dealt out of H7 ensure that they match the known order. The process for shuffling the cards out of H7 involves them initially being sent to H5 and H6 and then in a second shuffling round being sent to H2 and H7 and then back from H2 and H7 to H5 and H6 and with the process repeating until nine shuffling rounds have been conducted and the cards are found in H5 and H6. The cards can then be moved from H5 and H6 to H2 and dealt from H3 to H7. Thus, allowing the first set of cards to be used again.

Reshuffling the Second Set of Cards

It will be appreciated that once is determined to use the set of first cards again all the cards are moved from H3 and will be in holder H4. Cards of the second set can be re-shuffled using holder H4 to send the cards to H5 and H6 then in a second shuffling round sending the cards from H5 and H6 to H2 and H4 before sending them from H2 and H4 to H5 and H6 and repeating the process until nine shuffling rounds have been conducted and the cards can be sent to holder H2 and brought into use.

A person skilled in the art will appreciate that the above embodiment has a number of advantages. In particular, the use of the card holders with their chutes to store the cards provides a robust mechanism and does not rely on mechanisms such as splitting a set of cards. Further, in conjunction with the above shuffling algorithm the method provides for a truly random ordering of the cards at completion. Employing the conveying mechanism allows the cards to be moved rapidly and is not necessary to control insertion of cards relative to other cards as they are always fed to the same place, i.e. to the bottom of a stack.

Reading the cards as they are dealt allows them to be validated against the expected dealing order and hence determine whether any errors have occurred. Further, the apparatus 200 knows where any card should be at any particular time. Thus, in embodiments incorporating further barcode readers it is possible to detect errors at any desired stage of the process.

The above described mechanism is such that during a shuffling round each movement from a source to a destination involves a partial shuffling of the cards—i.e. by dividing them amongst two destination holders. A person skilled in the art will appreciate that in alternative embodiments it will be possible to take advantage of movement rounds such as when in the above described embodiments all the cards are moved from two holders to a single holder, e.g. from H5 and H6 to H2 and to then shuffle the cards from a single source. Thus, technically it would be possible to shuffle an entire set of cards (made up of multiple decks) using only three card holders, but this requires some movement rounds in addition to shuffling rounds. For example, in the example above after the cards have been sent from H2 and H5 and H6 they could be sent first from H5 and then from H6 back to H2 without changing the order of any of the cards and then shuffled them by moving the back from H2 to H5 and H6.

It will also be appreciated from the above description that it would be technically possible to then also deal the cards out of H2. Similarly, cards could be loaded into holder H2 rather that holder H1 and read as they are moved from H2 to either H5 or H6.

While the overall number of card holders could be reduced in other embodiments, the arrangement of seven card holders used in the present embodiment has certain advantages as it allows two sets of cards to be dealt, and allows cards to be shuffled while being dealt, and allows cards to be validated externally of the housing.

Example Of Game Play

FIG. 7*a* to 7*d* are schematic diagrams showing an example of game play for the game black jack. Where possible equivalent numbering from FIGS. 1 and 2 is used. Accordingly, cards are dealt from holder H3 along conveying section C3. Card presentation mechanism 230 physically displays the cards to the players (the actual pivoting mechanism with cages on the end of each are not being shown in FIG. 7*a*). The card at presentation position 230 741*a* is a nine of spades which is the real card dealt to the dealer and is displayed as virtual card 741*b* on display 127. It will also be appreciated that each of displays 111*a* to 111*c* shows virtual cards 711, 721 and 731 corresponding to the cards which were previously been dealt and have been sent by Switch S2 into the interior of the shuffling apparatus for storage. Accordingly, the position shown in FIG. 7*a* corresponds to the end of a first round of the game. In a second round of the game further cards are dealt from position H3 and move along conveyer section C3 and as can be seen each player now has two cards 711, 712, 721, 722, 731, 732 and the real physical card 742*a* is shown as face down with a corresponding virtual face down card 742*b* shown on the dealer's display 127. This card will be turned face up later in the game play.

Figure 7A:
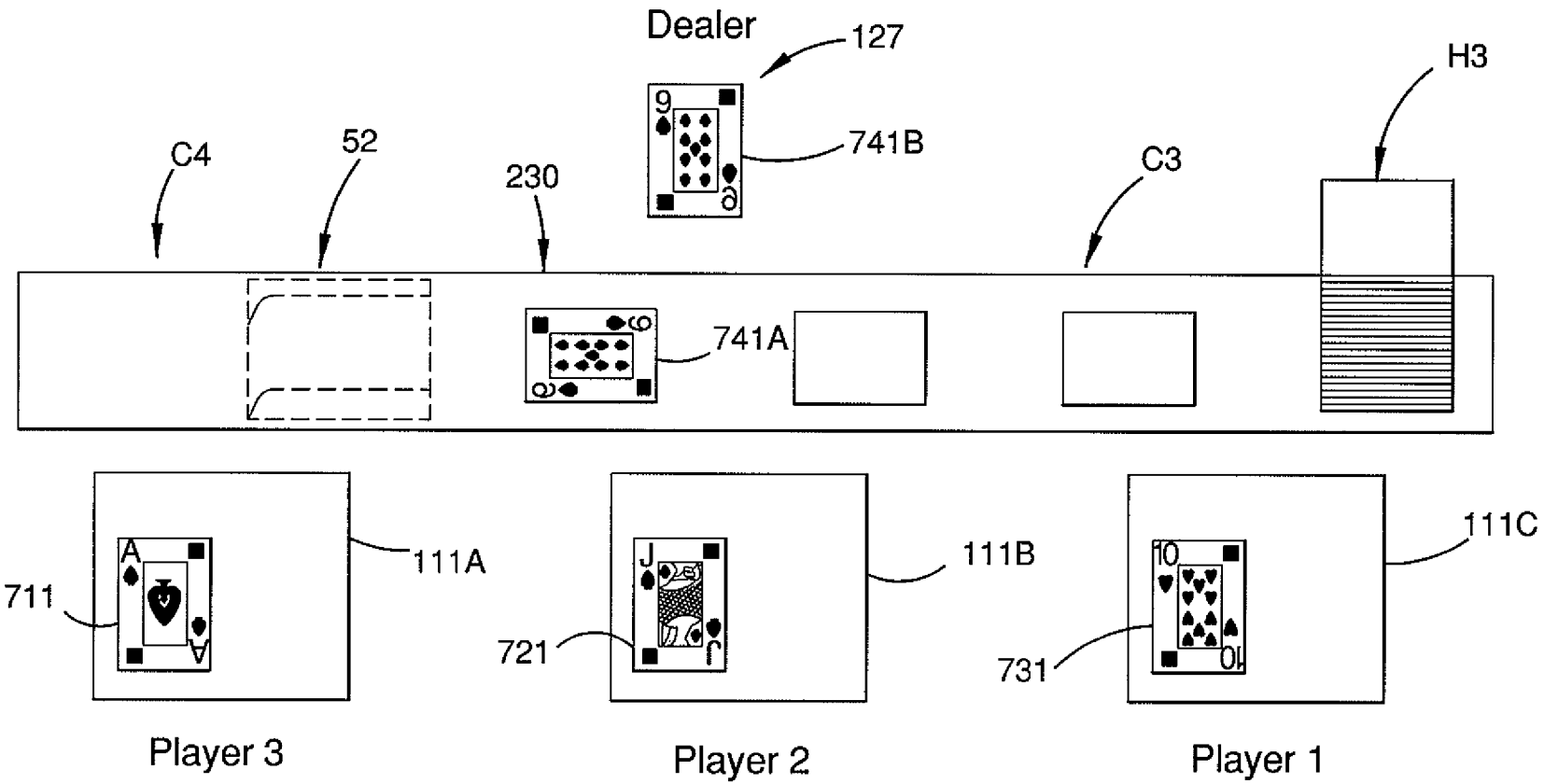
Figure 7B:
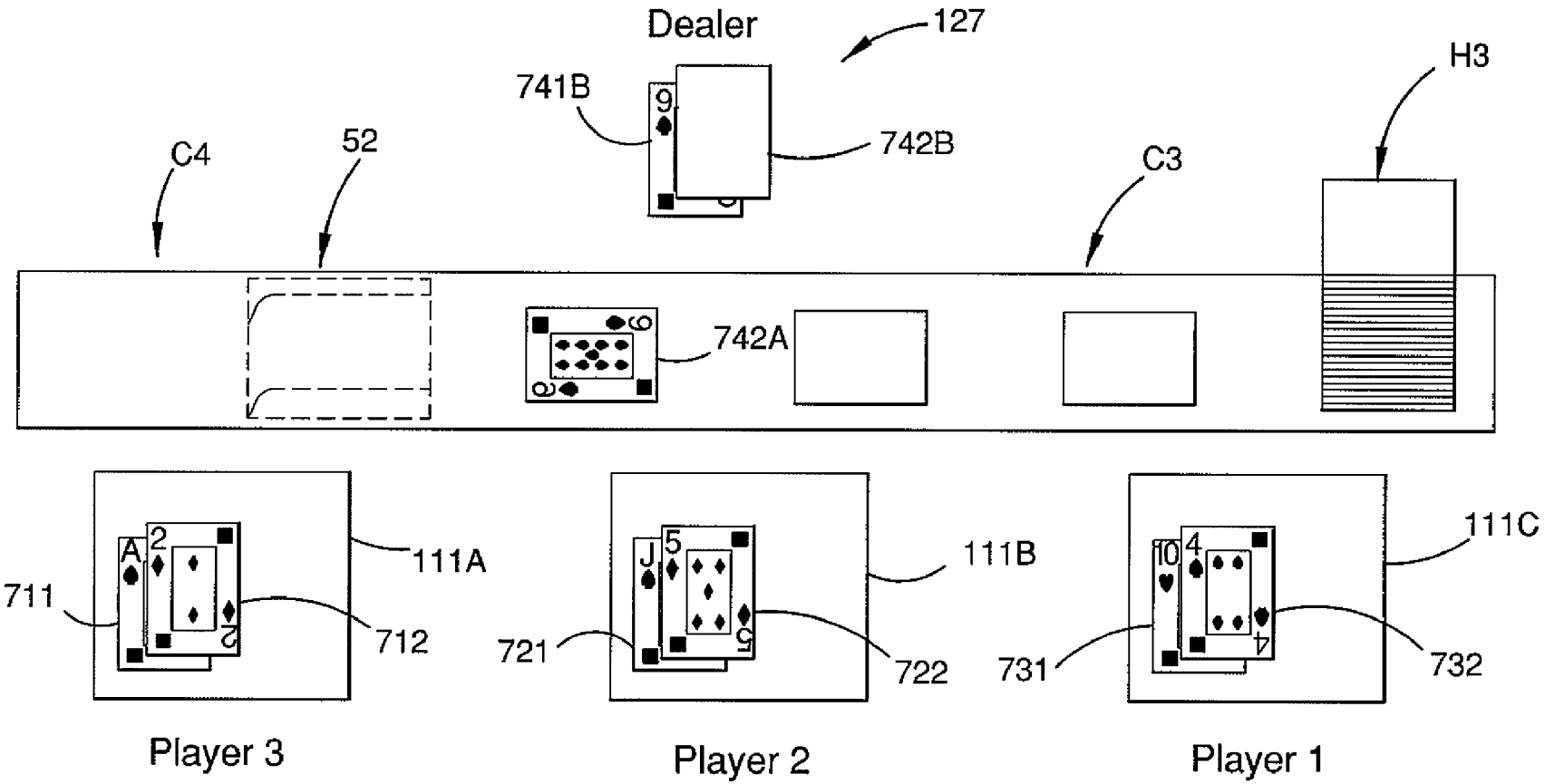
Figure 7C:
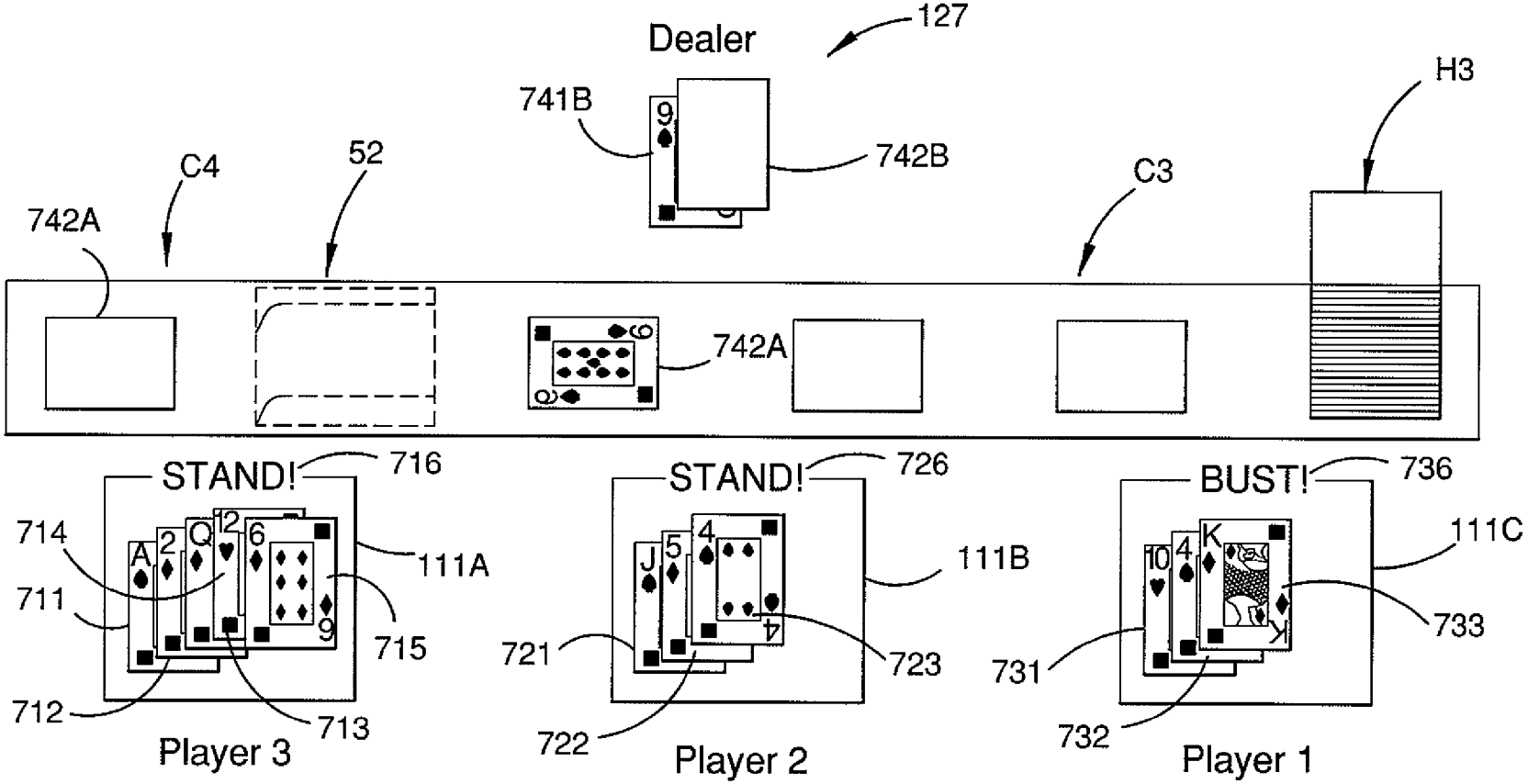

FIG. 7*c* shows a third round where each player draws cards until he stands or busts. The dealer's virtual card 742*b* is still shown as face down and has been moved to conveyor section C4 which is the holding area, in order to be held until it is time to turn it face up. Thus, the players know that the card has been dealt to the dealer is still physically viewable and has not been sent to the interior of the apparatus and, hence ameliorating any player concern about the card being swapped.

It will be seen that the player using display 111*a* has drawn five cards 711 to 715 and has decided to stand as indicated by graphic 716. Similarly the player using station 11 11*b* has drawn three cards 721, 723 and decided to stand 726. The player using display 111*c* has drawn three cards but has bust 736 and accordingly is out of the game.

Figure 7D:
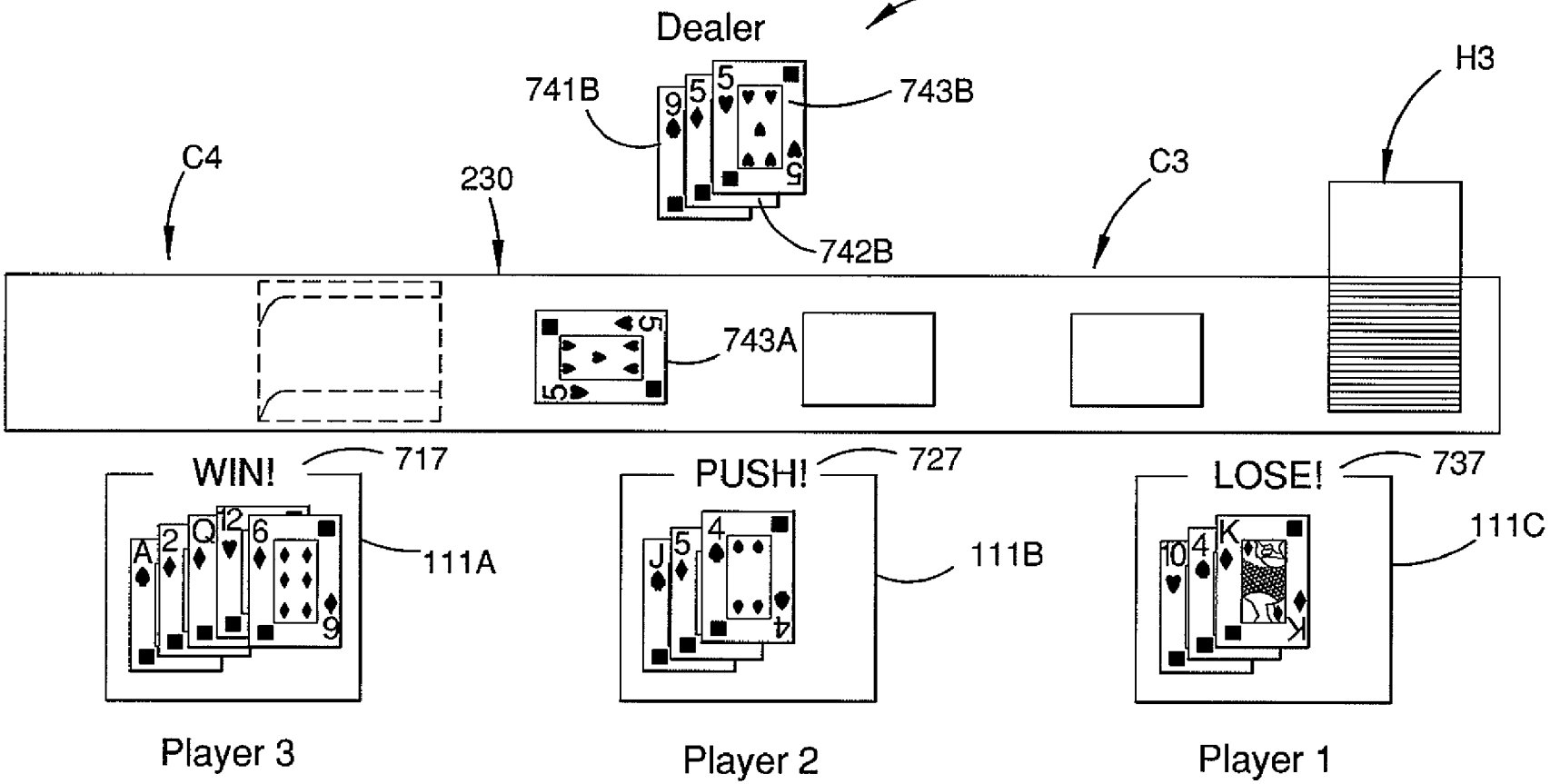

FIG. 7*d* shows the fourth round where the dealer opens his face down card and draws cards until above 17 or bust. Initially in this round the face down card is moved from conveyor section C4 back to the presentation mechanism 230 and turned over and is then displayed on the display 127 as virtual card 742*b*. From this it will be seen that the player has then been dealt a third card 743*a* which has been presented by presentation mechanism 230 and then added to display 127 as virtual card 743*b*. Each player display is then updated to indicate whether the wins 717, draws 727 or loses 737.

Further Advantages of the Shuffling Apparatus

It will be appreciated that the above apparatus has a number of additional advantages. Firstly, the technique allows the shuffle order to be validated. Further, both real and virtual cards are displayed to the player. Still further, the apparatus is in effect a continuous loop shuffling apparatus such that each set of cards can be returned and shuffled again. Indeed, it is particular advantageous that two such sets of cards can be shuffled and dealt in a continuous loop. Thus, allowing the machine to be in continual use for a long period of time. The dealing mechanism is advantageous in that it allows cards to be dealt face down and then selectively moved from a face down position to a viewable position. As indicated above such a viewable position would depend on the configuration of the table, but is preferred to be face up so that it is viewable from both sides of the table. Further, the dealing mechanism is arranged such that some cards can be held face down. This allows cards to be dealt in a desired order in relation to the game. A person skilled in the art will appreciate that the storage area C4 could be adapted to receive further cards, for example, it could employ a turntable like mechanism in order to send the cards to a large number of destinations.

The use of cards with barcodes which identify both the manufacturer and the specific individual set of cards is advantageous as it allows not only the cards to be shuffled but also to be validated to avoid the introduction of the additional cards or to check a deck for missing cards.

Alternative Applications

A person skilled in the art will appreciate that the above techniques, in particular, number allocation and the technique of moving cards between holders can be applied in other areas where it is desired to order a set of substrates which carry data. In such embodiments, it may not be desirable or required to randomly allocate numbers to the data carrying substrate. Indeed, it may be desirable to allocate numbers in such a way that the substrates can be placed in a desired order with a minimal number of movements between different mechanisms. For example, if the data carrying substrates were bank notes, numbers could be allocated based on the desired end order of different denominations of the notes, such that a set of notes in mixed denomination order could be re-ordered into a desired order. As the controller 410 allows the destination to be chosen, the conveyor mechanism can be controlled by the controller 410 to select destination data carrying substrate holder of two data carrying substrate holders (i.e. the card holder has been renamed in accordance with their function of holding data substrates rather than cards). Similarly, the feed mechanism described above in relation to the controller could be used in other techniques. Further, other things that require a random shuffling mechanism could use the shuffling algorithm as described above. Accordingly, in an alternative embodiment there is provided a processing apparatus which processes data carrying substrates having a series of holders as described above and a conveying mechanism linking them such that a controller controls the conveying mechanism to selectively control the destination: the feed mechanism described above being employed in this embodiment to ensure that only one data carrying substrate is fed at one time.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art in any country.

The claims defining the invention are as follows:

1. A shuffling apparatus comprising: at least three card holders, each card holder adapted to hold at least one deck of cards; a processor; a conveying mechanism adapted to convey cards between each card holder and at least two other card holders, the conveying mechanism controllable to select a destination card holder of the at least two card holders; and a controller arranged to control the conveying mechanism in a shuffling mode by a series of software modules executed by the processor in which cards are sent between a card holder acting as a source card holder and selected ones of the at least two destination card holders, wherein the at least three card holders comprise at least four card holders comprising two pairs of card holders, and wherein the controller is arranged to conduct at least one shuffling round during which one pair of card holders are source card holders and the other pair of card holders are destination card holders, the controller controlling the conveying mechanism to distribute cards from a first of the pair of source card holders between the pair of destination card holders and subsequently distribute destination card holders, wherein subsequent to completion of the cards from a second of the pair of source card holders between the pair of shuffling rounds, the controller is configured to control the conveying mechanism to convey the shuffled cards to a further card holder from which they may be dealt, wherein the further card holder is one of a pair of dealing card holders from which cards may be dealt, wherein the pair of dealing card holders are mounted to be movable between a first position for receiving shuffled cards and a second card position from which cards are dealt, wherein the pair of dealing card holders are mounted for rotational movement around a common axis between the first and second positions.

2. A shuffling apparatus as claimed in claim 1, wherein the conveying mechanism comprises a dealing portion viewable by players along which conveying mechanism the cards are conveyed after being dealt.

3. A shuffling apparatus as claimed in claim 1, wherein the feeding mechanism comprises a plurality of driveable members, including at least two rollers or belts and wherein when a card is being fed by the feeding mechanism from a card holder at least one roller or belt is driven against the feed direction during at least part of the feeding to act to reject the feeding of more than one card simultaneously.

4. A shuffling apparatus as claimed in claim 1, wherein the conveying mechanism comprises at least one switching mechanism controllable by the controller to control the destination of a conveyed card from any of the at least three card holders directly to each of the other at least two destination card holders.

5. A shuffling apparatus as claimed in claim 4, wherein the controller is configured to conduct an initial shuffling round during which one card holder is a source card holder and a pair of card holders are destination card holders, the controller controlling the conveying mechanism to distribute cards from the source card holder between the pair of destination card holders.

6. A shuffling apparatus as claimed in claim 4, wherein the controller is configured to control the conveying mechanism in a moving mode in which cards are sent between one source card holder and one destination card holder.

7. A shuffling apparatus as claimed in claim 4, wherein the at least three card holders comprise at least four card holders comprising two pairs of card holders, and wherein the controller is arranged to conduct at least one shuffling round during which one pair of card holders are source card holders and the other pair of card holders are destination card holders, the controller controlling the conveying mechanism to distribute cards from a first of the pair of source card holders between the pair of destination card holders and subsequently distribute cards from a second of the pair of source card holders between the pair of destination card holders.

8. A shuffling apparatus as claimed in claim 7, wherein subsequent to distribution of the cards to the destination card holders, a role of at least one of the three card holders is reversed from a source card holder to a destination card holder, and a role of at least one other of the at least three card holders is reversed from a destination card holder to a source card holder, such that at least one of the destination card holders holding the cards now act as source card holders and wherein the controller is configured to conduct at least one further shuffling round during which the controller controls the conveying mechanism to distribute cards from a first of the card holders acting as a source between the pair of card holders now acting as a destinations and subsequently distribute cards from a second of the pair of card holders now acting as a source between the pair of destination card holders.

9. A shuffling apparatus as claimed in claim 7, wherein subsequent to completion of the shuffling rounds, the controller is configured to control the conveying mechanism to convey the shuffled cards to a further card holder from which they may be dealt.

10. A shuffling apparatus as claimed in claim 9, wherein the controller is configured to conduct sufficient shuffling rounds to make the arrangement of the cards conveyed to the further card holder random.

11. A shuffling apparatus as claimed in claim 10, wherein the controller is configured to conduct nine shuffling rounds including the initial shuffling round.

12. A shuffling apparatus as claimed in claim 1, wherein a card feeding mechanism is associated with each card holder, each card feeding mechanism, and the feeding mechanism is configured to feed individual cards to and from the respective card holder.

13. A shuffling apparatus as claimed in claim 1, wherein the apparatus comprises a data structure storing shuffling data, and the controller controls movement of the cards based on the shuffling data.

14. A shuffling apparatus as claimed in claim 1, wherein the controller is configured to generate the shuffling data.

15. A shuffling apparatus as claimed in claim 14, wherein the controller is configured to generate the shuffling data by associating a different plural digit number with each card, the controller is configured to employ the value of one of the digits to control a destination of each card in each shuffling round and configured to employ different digits of the plural digital number in respective ones of a plurality of shuffling rounds.

16. A shuffling apparatus as claimed in claim 15, comprising a card reader arranged to obtain identification data from each card prior to shuffling the cards, and wherein the controller associates the identification data with the plural digit number when generating the shuffling data.

17. A shuffling apparatus as claimed in claim 16, wherein the card reader is a barcode reader adapted to read a barcode on each card.

18. A shuffling apparatus as claimed in claim 1, comprising a further card reader configured to obtain a card identification data after the card shuffling has been completed and wherein the controller is configured to determine an expected card order based on the shuffling data, and to determine whether shuffled cards are in the expected card order based on the card identification data obtained by the further card reader.

19. A shuffling apparatus as claimed in claim 18, wherein the further card reader is a barcode reader adapted to read a barcode on each card.

20. A shuffling apparatus as claimed in claim 19, wherein the further card holder is one of a pair of dealing card holders from which cards may be dealt.

21. A shuffling apparatus as claimed in claim 18, wherein the further card reader is adapted to read cards as they are dealt from the further card holder.

22. A shuffling apparatus comprising: at least three card holders, each card holder adapted to hold at least one deck of cards; a processor; a conveying mechanism adapted to convey cards between each card holder and at least two other card holders, the conveying mechanism controllable to select a destination card holder of the at least two card holders; and a controller arranged to control the conveying mechanism in a shuffling mode by a series of software modules executed by the processor in which cards are sent between a card holder acting as a source card holder and selected ones of the at least two destination card holders, wherein the at least three card holders comprise at least four card holders comprising two pairs of card holders, and wherein the controller is arranged to conduct at least one shuffling round during which one pair of card holders are source card holders and the other pair of card holders are destination card holders, the controller controlling the conveying mechanism to distribute cards from a first of the pair of source card holders between the pair of destination card holders and subsequently distribute destination card holders, wherein subsequent to completion of the cards from a second of the pair of source card holders between the pair of shuffling rounds, the controller is configured to control the conveying mechanism to convey the shuffled cards to a further card holder from which they may be dealt, wherein the further card holder is one of a pair of dealing card holders from which cards may be dealt, further comprising a card presentation mechanism associated with the dealing portion and controllable by the controller to move dealt cards from a face down position to a viewable position.

23. A shuffling apparatus as claimed in claim 22, wherein the card presentation mechanism is controllable by the controller to turn cards face up.

24. A shuffling apparatus as claimed in claim 22 wherein the conveying mechanism is configured to convey cards from the dealing portion to a card holder acting as a card return holder for receiving the dealt cards and holding them until they are shuffled again.

25. A shuffling apparatus as claimed in claim 22, configured to shuffle cards of a second set of cards while dealing a first set of cards.

26. A shuffling apparatus as claimed in claim 25 comprising at least six card holders, and four of the at least six card holders act as shuffling card holders while the other two card holders act as a dealing holder and a card return holder.

27. A shuffling apparatus as claimed in claim 26, wherein the processor is configured to direct two of the card holders swap roles between being a shuffling card holder and a card return holder between shuffling sequences.

28. A shuffling apparatus as claimed in claim 26, wherein the card holder and feeding mechanism are arranged to feed cards either from and to the bottom of a stack of cards in the card holder or from and to the top of a stack of cards in the card holder.

29. A shuffling apparatus as claimed in claim 22, wherein the controller comprises a master controller and a plurality of sub-controllers arranged to control different parts of the shuffling apparatus.

* * * * *